US008267156B2

(12) United States Patent
Wang et al.

(10) Patent No.: US 8,267,156 B2
(45) Date of Patent: Sep. 18, 2012

(54) STREAMLINED ORIFICE OF OUTDOOR UNIT

(75) Inventors: Yu Wang, Avon, IN (US); Larry D. Burns, Avon, IN (US); Loren D. Hoffman, Avon, IN (US); Duane V. Douglas, Indianapolis, IN (US); William B. Sutherlin, Indianapolis, IN (US); Frank J. David, Avon, IN (US); Derek A. Leman, Brownsburg, IN (US); Peter R. Bushnell, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 1115 days.

(21) Appl. No.: 12/095,393

(22) PCT Filed: Dec. 30, 2005

(86) PCT No.: PCT/US2005/047471

§ 371 (c)(1),
(2), (4) Date: May 29, 2008

(87) PCT Pub. No.: WO2007/087287

PCT Pub. Date: Jul. 12, 2007

(65) Prior Publication Data

US 2008/0292459 A1 Nov. 27, 2008

(51) Int. Cl.

| | |
|---|---|
| ***F25B 29/00*** | (2006.01) |
| ***F25F 7/00*** | (2006.01) |
| ***F24H 3/06*** | (2006.01) |
| ***F28F 13/12*** | (2006.01) |

(52) U.S. Cl. ..... 165/58; 165/69; 165/121; 165/122; 165/125; 415/220

(58) Field of Classification Search ..... 165/58, 165/69, 121, 122, 125; 415/220
See application file for complete search history.

(56) References Cited

U.S. PATENT DOCUMENTS

| | | | | |
|---|---|---|---|---|
| 4,191,245 | A | | 3/1980 | Wendt et al. |
| 4,202,409 | A | | 5/1980 | Cann et al. |
| 4,307,778 | A | | 12/1981 | Tobin et al. |
| 4,391,322 | A | | 7/1983 | Ciarlei et al. |
| 4,454,641 | A | | 6/1984 | Haas et al. |
| 4,723,419 | A | | 2/1988 | Kessler et al. |
| 4,858,683 | A | | 8/1989 | Beehler |
| 4,945,982 | A | | 8/1990 | Das |
| 5,066,194 | A | * | 11/1991 | Amr et al. ..... 165/125 |
| 5,911,563 | A | | 6/1999 | Duppert et al. |
| 5,967,748 | A | | 10/1999 | Jang |
| 6,866,474 | B2 | | 3/2005 | Uselton |
| 2003/0182954 | A1 | | 10/2003 | Parker et al. |
| 2004/0165986 | A1 | | 8/2004 | Parker et al. |

OTHER PUBLICATIONS

International Search Report and Written Opinion mailed Jun. 27, 2006 (12 pgs.).
International Preliminary Report on Patentability mailed Oct. 29, 2007 (7 pgs.).

* cited by examiner

*Primary Examiner* — Ljiljana Ciric
(74) *Attorney, Agent, or Firm* — Cantor Colburn LLP

(57) ABSTRACT

A comfort system outdoor unit with a heat exchanger coil and a fan in its top opening has an orifice structure and an insert registerable with the orifice structure to streamline the inward flow of air that passes over a lower end of the orifice structure. The insert may be fastened directly to the orifice structure lower end, or it may be installed so as to extend substantially from an upper edge of the coil to the orifice structure lower end.

13 Claims, 4 Drawing Sheets

STREAMLINED ORIFICE OF OUTDOOR UNIT

BACKGROUND OF THE INVENTION

This invention relates generally to outdoor units for air conditioners/heat pumps and, more particularly, to a method and apparatus for adapting the orifice to reduce sound levels and flow losses.

Air cooled condensers, as commonly used in residential air conditioning systems, employ fin tube construction to transfer heat from the refrigerant to the outdoor air. As hot, high pressure refrigerant passes through the coil, heat from the compressed refrigerant is transferred through the tubes to the attached fins. An electrically powered fan is then used to draw large quantities of outside air across the fin heat transfer surfaces to remove heat from the refrigerant so that is will condensed and partially subcooled prior to its reaching the expansion valve.

In heat pump application, the same outdoor unit operates in much the same manner but the heat exchanger operates as an evaporator rather than a condenser. Air conditioners and heat pumps are sometime referred to generically as comfort systems.

The heat exchanger coil of an outdoor unit is usually round, rectangular, or square in form, and the compressor is normally disposed within the coil. A fan and its drive motor is commonly mounted above the heat exchanger coil such that the fan draws outdoor air inwardly through the coil and then upwardly to be discharged into the atmosphere.

In order to guide the airflow stream in the vicinity of the fan, i.e. particularly as it flows radially inwardly to the fan and as it is discharged to the atmosphere at the top of the fan, a so called orifice structure is included at the top of an outdoor unit to provide a smooth surface over which the air is caused to flow. Typically the orifice has a cross section that resembles an inverted U with an outer leg wrapped over the outer side of the coil and an inner leg which extends downwardly in the vicinity of the fan. At the lower end of the inner leg, there is a slight radially outward flare, but the inner leg normally protrudes into the airflow stream.

The applicants have recognized that the inner leg or orifice leading edge causes flow disturbances, thereby resulting in efficiency losses and increased sound levels. Ideally, the outwardly flaring portion of the inner leg would be extended to provide a smooth surface over which the air can flow rather than a sharp edge that disrupts the flow pattern. However, the normal process of forming the orifice structure from sheet metal does not allow such an approach because of splitting or tearing of the sheet metal material that tends to occur.

SUMMARY OF THE INVENTION

Briefly, in accordance with one aspect of the invention, an insert is installed near the orifice leading edge to thereby change the airflow pattern thereover in such a way as to reduce the sound level and increase the efficiency of the system by decreasing the flow losses that would otherwise occur.

By another aspect of the invention the insert is attached to and supported by the orifice leading edge.

By yet another aspect of the invention, the insert extends from a point near the orifice leading edge and extends upwardly and outwardly at an angle so as to interface with the outer edge of the orifice structure.

By still another aspect of the invention, the insert includes structure that engages an inner surface at the orifice structure.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
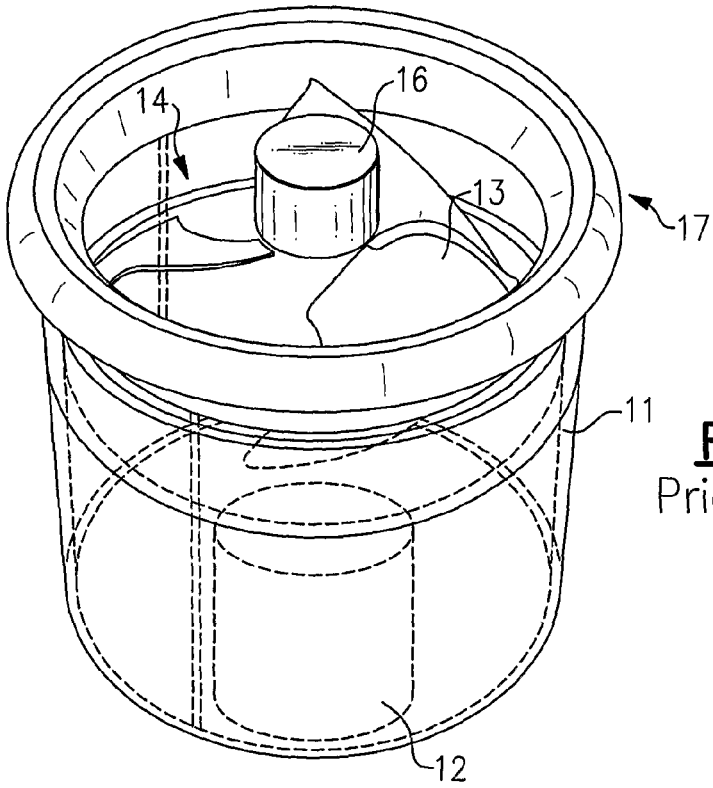
FIG.1 Prior Art
FIG. 1 is a perspective view of an outdoor unit in accordance with the prior art.

Shown in FIG. 1 is a conventional outdoor unit of an air conditioning system in accordance with the prior art. The heat exchanger coil 11 is shown as a cylindrical structure, although it may just as well be square or rectangular in shape. A compressor 12 is located within the coil 11 and is connected to pump refrigerant vapor through a vapor compression cycle. A fan 13 is centrally disposed within a top opening 14 and includes an electric drive motor 16 for rotating the fan 13.

In operation, the fan 13 is rotated by the motor 16 to draw ambient air radially inwardly through the heat exchanger coil 11, after which the warmer air is discharged upwardly through the top opening 14.

Figure 2:
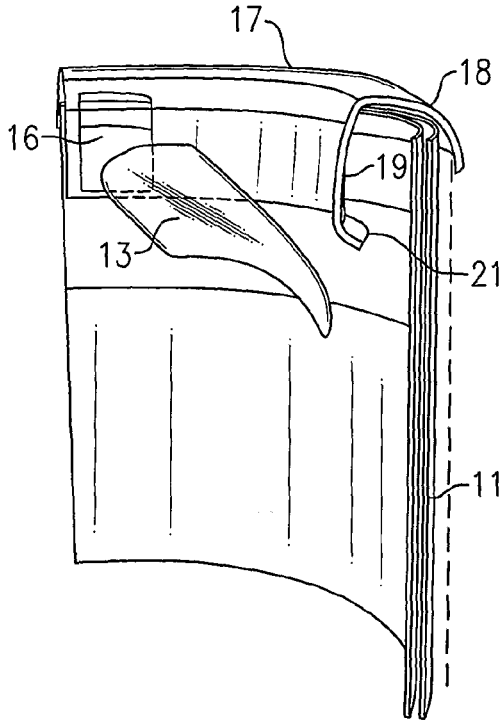
FIG.2 Prior Art
FIG. 2 is a partial perspective view thereof showing the orifice structure in particular.

At the top of the coil 11, a so called top or orifice structure 17 is placed around the coil 11 so as to surround the opening 14. As will be seen in FIG. 2, the top 17 is generally an inverted U-shaped member having an outer leg 18 which wraps around the upper edge surface of the coil 11 and an inner leg 19. At the lower end of the inner leg 19 the structure flare radially outwardly to an orifice leading edge 21 as shown in FIG. 2.

Figure 3:
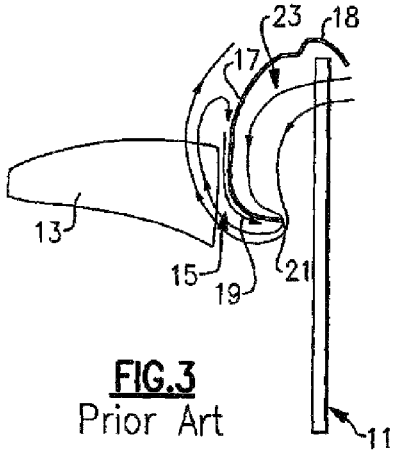
FIG.3 Prior Art
FIG. 3 is a schematic illustration thereof showing the pattern of the airflow over the orifice structure.

Considering now the pattern of airflow as it flows radially inwardly, around the orifice leading edge 21 and then upwardly out the top opening 14, it will be seen in FIG. 3 that outside and above the orifice leading edge 21, the air is drawn radially inwardly to a cavity 23, and then downwardly from where it must then flow radially outwardly to get around the orifice leading edge 21. Accordingly, it is caused to change directions at that point very quickly as shown. This phenomenon not only causes significant flow losses but also creates a significant amount of noise. Because of these flow losses a large separation bubble will be created at 15 when the resulting flow interacts with fan blades 13 thereby generating high noise levels.

Figure 4:
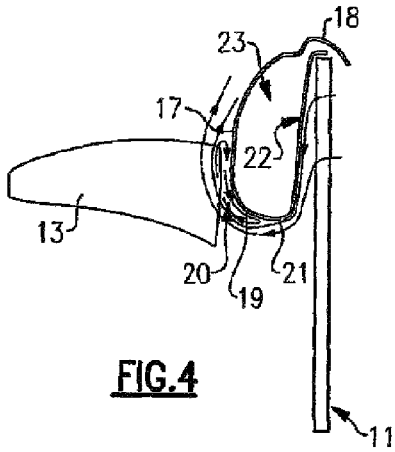
FIG. 4 is a schematic illustration of an installed insert in accordance with the present invention.

As will be seen in FIG. 4, the applicants have addressed these problems by providing an insert 22 that extends between the outer leg 18 and the orifice leading edge 21 to thereby close the cavity 23 into which the airflow entered in accordance with the prior art embodiment of FIG. 3. The result is that the flow stream of air is much smoother and is not caused to reverse direction as will be seen in FIG. 4. In this way, both the flow losses and the noise are substantially reduced. Because the flow losses are reduced, the separation bubble 20 will be much smaller, and therefore the noise will be substantially reduced.

Figure 5:
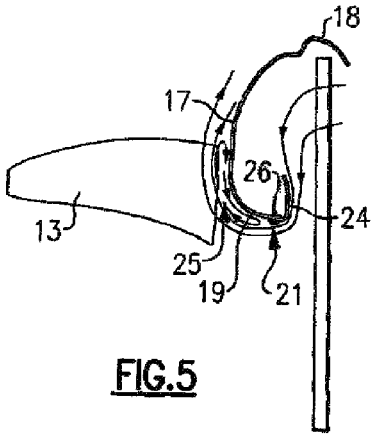
FIG. 5 is an alternative form thereof

As an alternative approach, rather than the insert 22 extending the entire distance between the outer leg 18 and the orifice leading edge 21 as shown in FIG. 4, a modified insert 24 comprises a small curvilinear element as shown in FIG. 5. Such an insert may be attached to the inner leg 19, near the orifice leading edge 21, by way of a plurality of fasteners 26 or the like. As will be seen in FIG. 5, the resulting airflow stream will be drawn in slightly more radially than the FIG. 4 embodiment but not nearly as much as the FIG. 3 embodiment, and the flow stream around the orifice leading edge 21 is curved and smooth, such that very little losses and noise are created. Because the flow losses are reduced, the separation bubble 25 will be much smaller, and therefore the noise will be substantially reduced.

Figure 6:
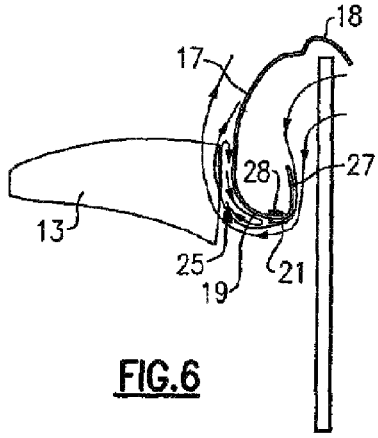
FIG. 6 is yet another alternative embodiment thereof.

A similar modified insert is shown at 27 in FIG. 6. The insert 27 is substantially the same shape as the insert 24 of the FIG. 5 embodiment, and the resulting airflow pattern is substantially the same. However, the means of attachment is modified such that rather than using fasteners 26 as shown in FIG. 5 a clip arrangement 28 is provided at the lower end of the modified insert such that the two arms of the clip 28 are disposed on opposite sides of the orifice leading edge 21 as shown.

Figure 7A:
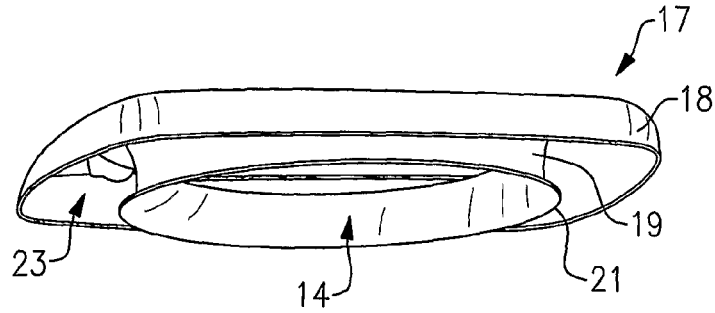
FIGS. 7A and 7*b* are is a perspective views of a typical orifice structure to which the present invention relates.
Figure 7B:
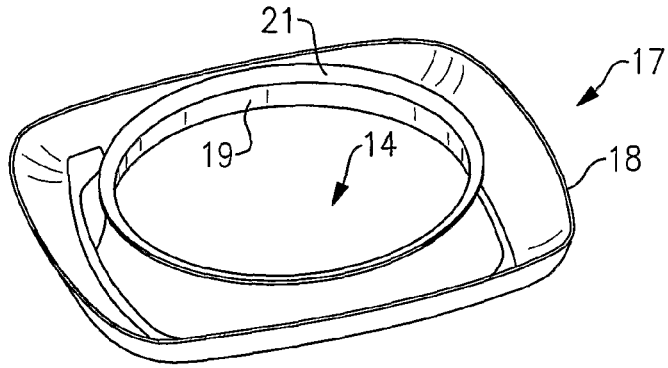

Referring now to FIGS. 7A and 7B, the top 17 is shown in an upright and an inverted position, respectively. It will be seen that the cavity 23 between the outer leg 18 and inner leg 19 is adaptable for receiving the insert 22 therein. The insert is shown in FIG. 8A-8C.

Figure 8A:
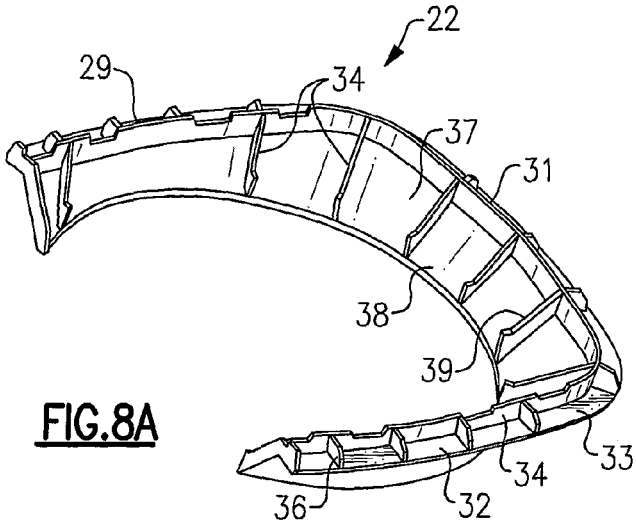
FIGS. 8A-8C are perspective views of the insert in accordance with the present invention.

In FIG. 8A the insert 22 is shown in an upright position and includes three sides 29, 31 and 32 in a generally rectangular relationship. These three sides correspond with the three sides of the heat exchanger coil. The fourth side, which is open, corresponds to the side on which there is no coil and on which the controls and various attaching fixtures are located. It will, of course, be understood that the shape and configuration of this insert 22 can be varied to accommodate the particular configuration of the unit. For example, round or square units are a common configuration for outdoor units.

Figure 9:
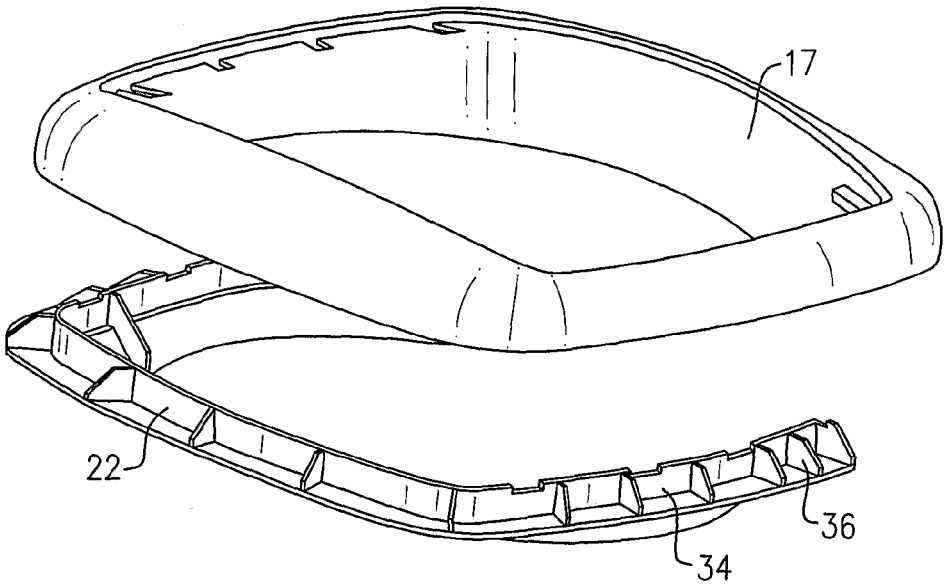
FIG. 9 is a perspective view of the orifice structure and insert in combination in accordance with the present invention.
Figure 8B:
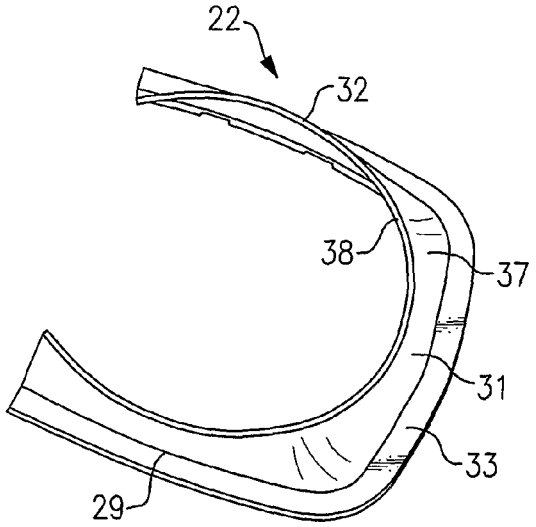
Figure 8C:
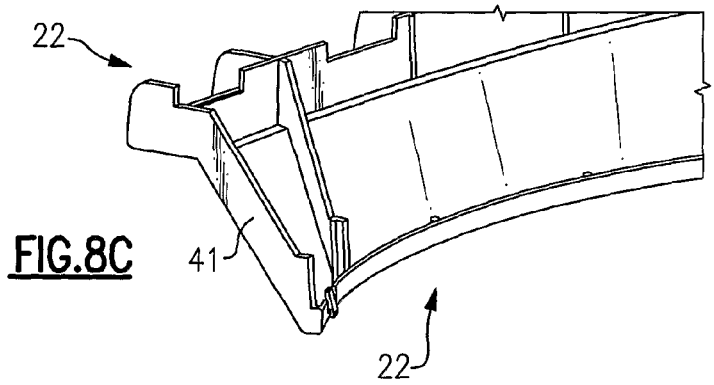

As will be seen in FIGS. 8A and 8B, the insert 22 includes a planar, generally horizontally disposed, rim 33, with an upstanding wall 34 extending upwardly from its inner edge. A plurality of stanchions 36 are disposed in spaced relationship on the upper surface of the planar rim 33. The upstanding wall 34 and the stanchions 36 are adapted to register with the inner surface of the top 17 when the insert 22 is installed therein as shown in FIG. 9.

Referring back to FIGS. 8A-8C, it will be seen that an oblique wall 37, is attached to the inner edge of the planar rim 33 and extends downwardly and inwardly to an inner edge 38. When installed in the top 17 the inner edge 38 is adapted to be in contact with, or in close proximity to, the orifice leading edge 21. On the inner side of the oblique wall 22 a plurality of ribs 39 are provided in spaced relationship for the purpose of adding strength and rigidity to the insert 22. Further, at each end of the insert 22 there is provided an end rib 41 for the purpose of adding strength and rigidity to the part. The insert 22 is adapted to rest on and be supported by the coil 11, with the rim 33 resting on top of the coil 11.

We claim:

1. A comfort system outdoor unit of the type having a compressor, a heat exchanger coil and a fan for drawing air inwardly through the heat exchanger coil and discharging it upwardly from an opening in the top of the unit, comprising:

an orifice structure installed in said top opening in the vicinity of the fan, said orifice structure being generally an inverted U-shape in cross section form with a radially outer leg extending over a top edge of said coil and a radially inner leg extending generally downwardly and then flaring radially outwardly at a lower end of said orifice structure inner leg; and an insert that is registrable with said orifice structure inner leg so as to form an upward extension of said orifice structure inner leg and thereby provide for a streamlined flow of air over said end.

2. The comfort system outdoor unit as set forth in claim 1 wherein said insert is connected to and supported by said orifice structure inner leg.

3. The comfort system outdoor unit as set forth in claim 2 wherein said insert is connected to said orifice structure inner leg by way of a plurality of fasteners.

4. The comfort system as set forth in claim 1 wherein said insert is adapted to rest on and be supported by the heat exchanger coil.

5. A comfort system outdoor unit of the type having a compressor, a heat exchanger coil and a fan for drawing air inwardly through the heat exchanger coil and discharging it upwardly from an opening in the top of the unit, comprising:

an orifice structure installed in said top opening in the vicinity of the fan, said orifice structure being generally an inverted U-shape in cross section form with a radially outer leg extending over a top edge of said coil and a radially inner leg extending generally downwardly and then flaring radially outwardly at a lower end of said orifice structure inner leg, said orifice structure outer leg and said orifice structure inner leg forming a cavity with an open side; and an insert that is registrable with said orifice structure inner leg so as to form an upward extension thereof and thereby provide for a streamlined flow of air over said end, said insert extending from said outer leg to said inner leg so as to thereby substantially close said cavity open side.

6. The comfort system outdoor unit as set forth in claim 5 wherein said insert is made of plastic.

7. The comfort system outdoor unit as set forth in claim 5 wherein said insert includes a horizontally disposed rim with a plurality of upstanding members attached thereto and engageable with an inner surface of said orifice structure outer leg.

8. A method of improving the airflow characteristics of a comfort system outdoor unit having a heat exchanger coil extending along at least two sides thereof and having an upper opening with a fan for drawing air inwardly through said coil and discharging it upwardly from the unit, comprising:

providing an orifice structure installed in said upper opening in the vicinity of the fan, said orifice structure being generally an inverted U-shape in cross section form with a radially outer leg extending over a top edge of said coil and a radially inner leg extending generally downwardly and then flaring radially outwardly at a lower end of said orifice structure inner leg; and providing an insert that is registerable with said orifice structure inner leg so as to form an upward extension of said orifice structure inner leg and thereby provide for a streamlined flow of air over said end.

9. The method as set forth in claim 8 and including the step of connecting said insert to said orifice structure inner leg.

10. The method as set forth in claim 9 wherein said insert is connected to said orifice structure inner leg by way of a plurality of fasteners.

11. The method as set forth in claim 8 wherein said insert is adapted to rest on and be supported by the heat exchanger coil.

12. A method of improving the airflow characteristics of a comfort system outdoor unit having a heat exchanger coil extending along at least two sides thereof and having an upper opening with a fan for drawing air inwardly through said coil and discharging it upwardly from the unit, comprising:

providing an orifice structure installed in said upper opening in the vicinity of the fan, said orifice structure being generally an inverted U-shape in cross section form with a radially outer leg extending over a top edge of said coil and a radially inner leg extending generally downwardly and then flaring radially outwardly at a lower end of said orifice structure inner leg to form jointly with said orifice structure outer leg a cavity with an open side;

providing an insert that is registerable with said orifice structure inner leg so as to form an upward extension thereof and thereby provide for a streamlined flow of air over said end; and structuring said insert to extend substantially from said orifice structure outer leg to said orifice structure inner leg so as to thereby substantially close said cavity open side.

13. The method as set forth in claim 12 and including the steps of providing a substantially horizontal rim and a plurality of upstanding members on said insert, with said upstanding members being registerable with an inner surface of said orifice structure upper leg.

* * * * *